US005454746A

United States Patent [19]

Guegan et al.

[11] Patent Number: 5,454,746

[45] Date of Patent: Oct. 3, 1995

[54] TOY HAND TOOL

[75] Inventors: Jacques Guegan, L'Hay les Roses; Francis Lecocq, Hames-Boucres; Jean-Pierre Moussaud, Les Attaques; Jean-Jacques Urvoy, Paris; Valerie Gautier, Paris; Francis Bance, Paris, all of France

[73] Assignee: Meccano, S.A., Calais, France

[21] Appl. No.: 267,925

[22] Filed: Jul. 6, 1994

Related U.S. Application Data

[63] Continuation-in-part of Ser. No. 23,897, Jun. 2, 1994.

[30] Foreign Application Priority Data

Jan. 6, 1994 [XH] Hague Agreement OMPI DM/028335

[51] Int. Cl.[6] ..... A63H 3/00; B25B 13/00

[52] U.S. Cl. ..... 446/72; 446/268; 81/52; D8/82; D21/120

[58] Field of Search ..... 446/72, 73, 144, 446/145, 86, 99, 97, 268; 81/52, 436, 177.1; D8/82, 83, 87; D21/120

[56] References Cited

U.S. PATENT DOCUMENTS

| | | | |
|---|---|---|---|
| D. 265,544 | 7/1982 | Nelson | D8/82 |
| D. 303,920 | 10/1989 | Kandel | D8/83 |
| D. 341,172 | 11/1993 | Olsen | D21/120 |
| 3,173,462 | 3/1965 | Koeppel . | |
| 4,356,659 | 11/1982 | Clarke | 446/97 |
| 4,551,110 | 11/1985 | Selvage et al. | 446/86 X |
| 4,950,912 | 8/1990 | Goldfarb et al. | 446/117 X |
| 5,078,641 | 1/1992 | Chen | 446/86 |

FOREIGN PATENT DOCUMENTS

| | | | |
|---|---|---|---|
| 812707 | 4/1959 | United Kingdom | 446/97 |

*Primary Examiner*—Mickey Yu
*Attorney, Agent, or Firm*—Pennie & Edmonds

[57] ABSTRACT

A manual tool, particularly adapted for use with construction toys has a human-like configuration. The tool includes a handle that is shaped as a lower half of a human figure and a cap that is shaped as an upper half of a human figure, including a head. The handle together with the cap completes a human-like figure. A longitudinal shank having a driver member extends from an upper end of the handle. The cap has a head shaped member connected to a body. The head shaped member is rotatably connected to the upper end of the body and has a neck portion that frictionally engages the shank. The upper end of the handle engages with a lower end of the body and is provided with an alignment projection for engaging a complementary hole formed on the lower end of the body. The projection permits the handle to properly align with the cap to complete the human-like figure. The projection also prevents the cap from rotating relative to the handle to maintain a proper human-like configuration when the cap is engaged with the handle.

15 Claims, 2 Drawing Sheets

TOY HAND TOOL

This is a continuation-in-part of application Ser. No. 29/023,897, filed Jun. 2, 1994, pending.

TECHNICAL FIELD

The present invention relates to a hand tool, more particularly to a screwdriver type adapted for use with construction toys.

BACKGROUND

Hand tools such as screwdrivers are generally used to tighten or loosen fasteners such as screws, bolts, nuts, etc. A screwdriver typically has a shank extending from a handle, with the end of the shank having a driver member integrally formed therewith or connected thereto. The driver member is shaped to engage a fastener and impart a rotational force thereto.

For example, U.S. Pat. No. Des. 341,172 issued to Olsen shows a toy tool having a triangular shaped driver member formed on the end of a shank.

U.S. Pat. No. Des. 265,544 issued to Nelson shows a screwdriver having a female figurine shaped handle.

U.S. Pat. No. 3,173,462 issued to Koeppel and U.S. Pat. No. 4,551,110 issued to Selvage et al disclose a typical hand operated screwdriver having a driver member consisting of a flat blade integrally formed on the end of the shank.

Hand toy tools or screwdrivers are merely used to tighten or loosen toy fasteners, just like regular screwdrivers. Once the toy has been constructed they are no longer useful until disassembly. It would be advantageous for a toy hand tool to provide a secondary toy function as well.

SUMMARY OF THE INVENTION

The present invention is drawn to a toy tool, particularly suitable for assembling construction toys. The toy tool according to the present invention comprises a longitudinal shank connected to a handle. A driver member is formed on the free end of the shank. The tool further has a cap adapted to completely cover the shank and the driver member and engage the handle.

When the cap is engaged with the handle, they form a human-like figure which can be used as a part of a construction toy. Specifically, the handle is shaped as a lower half of a human figure, i.e., the leg portion, whereas the cap is shaped as an upper half of a human figure, including the head portion. The cap and the handle together complete a human-like figure.

The cap comprises a longitudinal chamber dimensioned to permit the shank to pass therethrough. The head portion of the cap is hollow and is provided with a shank engaging portion dimensioned to frictionally engage the shank such that the cap is maintained in position relative to the handle portion when engaged.

The handle is provided with an alignment projection that cooperates with a hole formed on the cap to correctly align the lower body (handle) with the upper body (cap).

According to the toy tool of the present invention, the driver member preferably has a triangular shaped cross-section for driving a screw or bolt with a triangular recess. The tool can have a removably connectable extension driver member. The extension driver member mates with the driver member and is provided with a substantially identical driver member and/or other types of driver members for a quick interchageability.

Advantageously, the cap has a circular recess formed at its lower end which can be dimensioned to frictionally fit over a circular collar or bolt head such that it can be lockingly attached to toys.

BRIEF DESCRIPTION OF THE DRAWINGS

These and other features, aspects, and advantages of the present invention will become much more apparent from the following description, appended claims, and accompanying drawings.

DESCRIPTION OF THE DRAWINGS

Figure 1:
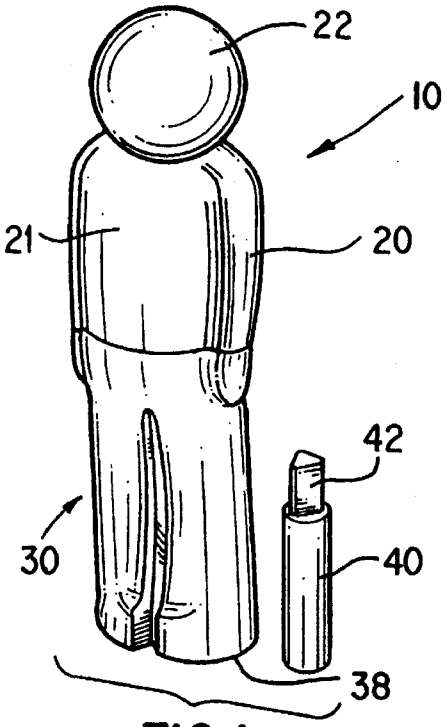
FIG. 1 shows a perspective view of the toy tool according to the present invention, with the cap and handle engaged to form a human-like figure, and a separate extension.

FIG. 1 shows a perspective view of a human-like figure shaped toy tool 10 according to the present invention, with a separate driver extension 40. The tool 10 comprises a handle 30 that is shaped as a lower half a human figure, i.e., the leg portion, and a cap 20 that is shaped as an upper half of a human figure, including a head. The handle 30 together with the cap 20 completes a human-like figure.

Figure 2:
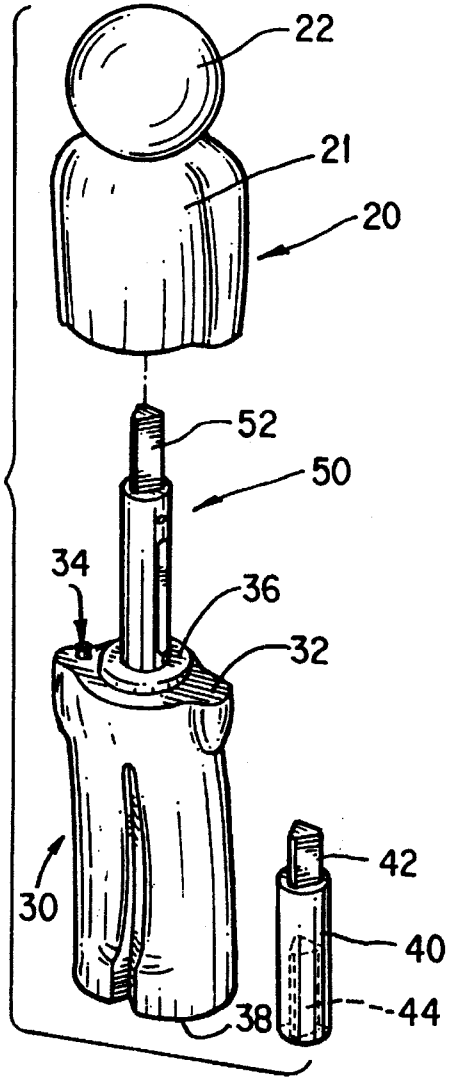
FIG. 2 is a perspective view similar to FIG. 1, with the cap removed to show the shank and the driver member.

FIG. 2 is shown with the cap 30 detached from the handle 20 to show the handle in its entirety. Specifically, a longitudinal shank 50 extends from an end 32 of the handle. The end 32 is preferably substantially flat. The shank is fixedly connected to the handle or integrally formed therewith so that there is no relative rotative movement between the shank and the handle. A driver member 52 extends substantially collinearly with the longitudinal axis of the shank. The driver member preferably is integrally formed with the shank and has a triangular cross-section for engaging a complementary triangular shaped recess formed in the fastener. However, the driver member could have any other geometric configuration, such as a hexagon (allen wrench), star (torx wrench) or square, either as a relief or recess configuration, or as a conventional phillips or flat head configuration.

Moreover, different types of driver member configurations can be readily attached to the driver member 52 in the form of a driver extension. Specifically, although one extension 40 is shown with a same triangular geometric configuration driver member 42 as the driver member 52, the driver member 42 can be of any other geometric configuration mentioned above. Accordingly, different types of driver members can be readily provided as desired by merely changing the extension. The other end of the extension has a recess 54 complementary to the geometric shape of the driver member 52, i.e., a triangular recess for the triangular driver member 52.

Figure 3:
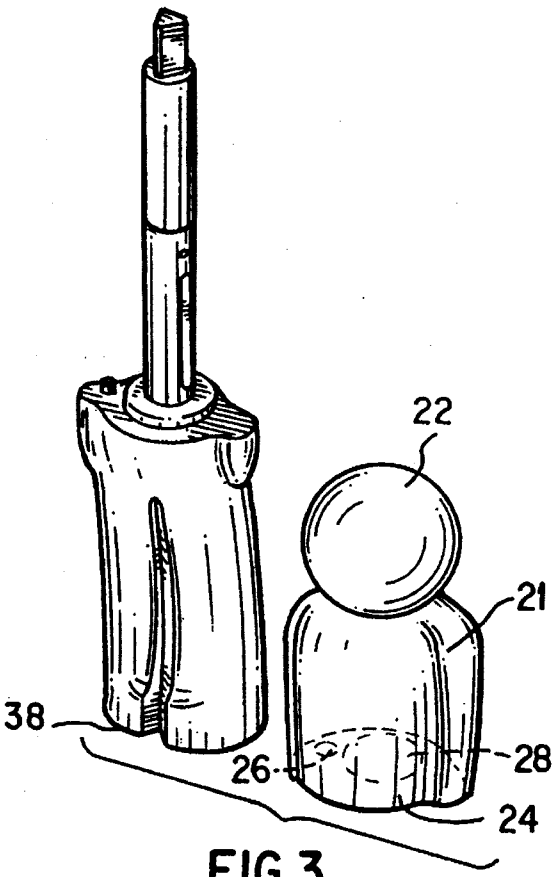
FIG. 3 is a perspective view similar to FIG. 2, with the extension attached to the driver member.

FIG. 3 shows the extension 40 inserted over the driver member 52. The extension also permits the tool to reach into deeper or recessed areas by increasing the overall working length of the shank.

Figure 4:
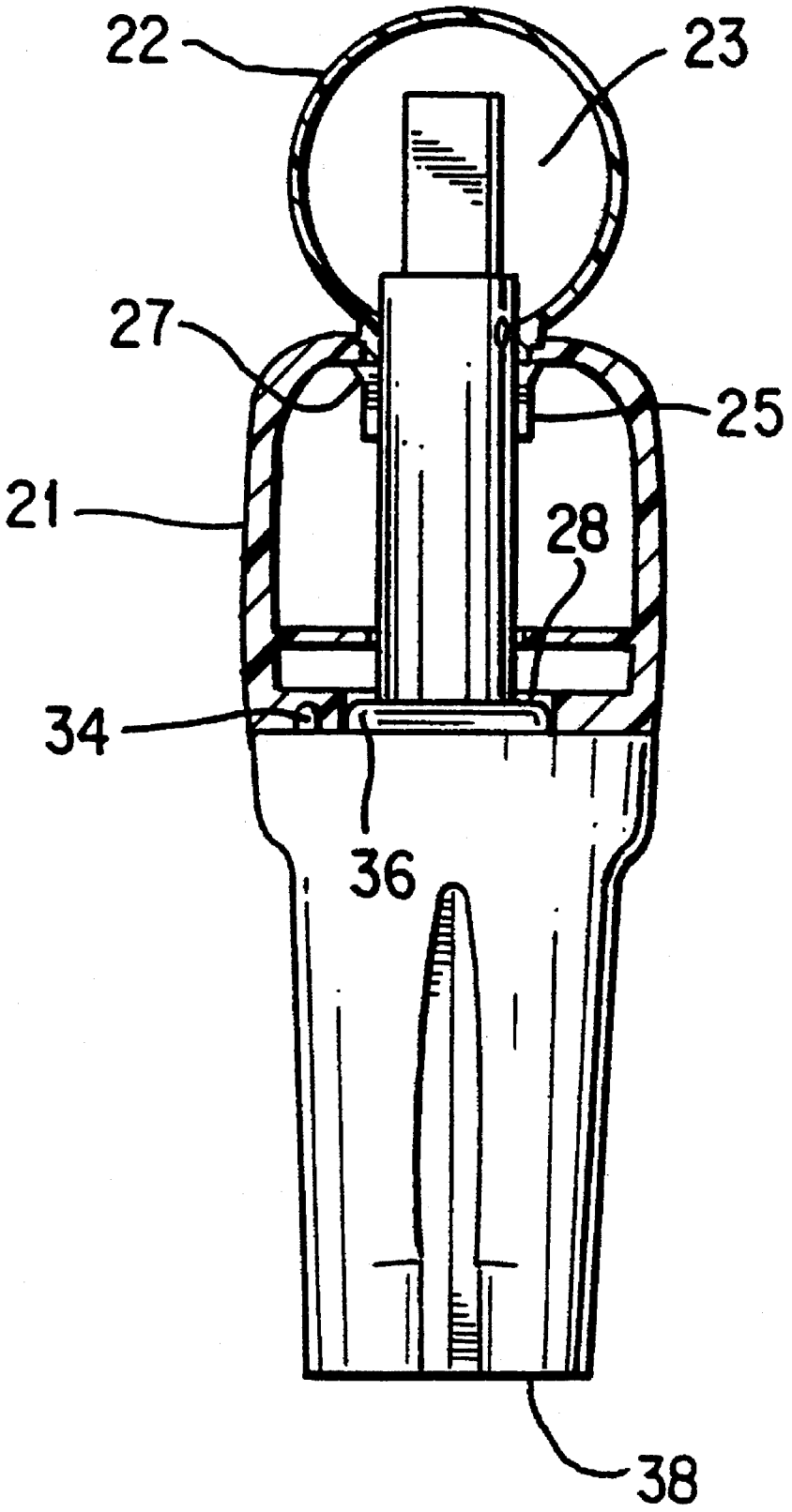
FIG. 4 is a front sectional view of FIG. 1, showing the cap engaged with the handle and the shank thereof.

As more clearly shown in FIG. 4, the cap 20 comprises has a head shaped member 22 connected to a body 21. The head shaped member 22 is preferably rotatably connected to the upper end of the body. As shown in FIGS. 3 and 4, the lower end 24 of the body is substantially flat so that it can stand upright on a flat surface and is provided with a circular recess 28.

The lower end or foot 38 of the handle is also preferably formed flat so that the tool 10 can stand upright on a flat surface. The flat end 32 of the handle engages with the flat end 24 of the body 21 as shown in FIG. 4. The flat end 32 of the handle is provided with an alignment projection 34 for engaging a complementary alignment hole 26 formed on the flat end of the body 21. Alternatively, the alignment projection 34 can be placed on the flat end 24 of the cap and the complementary alignment hole 26 in the flat end 32 of the handle. The projection 32 helps to align the lower body 30 with the upper body 20 to complete the human-like figure. The projection 32 also prevents the cap 20 from rotating relative to the handle 30.

The flat end 32 of the handle is preferably provided with a collar 36 of a predetermined diameter corresponding to the circular recess 28 formed in the flat end of the body 21. The collar 36 engages the recess 28 when the cap 30 is pulled over the shank to permit a frictional engagement. Also, the collar 36 cooperates with the alignment projection 34 and the alignment hole 24 to maintain a proper human-like configuration when the cap is engaged with the handle as shown in FIGS. 1 and 4.

As shown in FIG. 4, the head shaped member 22 is preferably hollow to permit insertion of a portion of the shank 50 which is preferably substantially cylindrical and the entire driver member 52. The head shaped member has an integral cylindrical neck portion 25 that extends into an opening formed in the upper end of the body. The neck portion is frictionally engaged to the body to permit rotation of the head member relative to the body. The neck portion is provided with a one-way snap fit tapered circular ridge 27 that has a larger diameter than the opening occupied by the neck portion. The tapering shape of the ridge permits insertion into the body, but is made difficult for removal in the opposite direction. Specifically, the cylindrical neck portion is provided with at least a pair of diametrically opposed vertical slots (not shown) to permit the diameter of the neck portion to decrease when pushed into the opening formed in the upper end of the body, but returned to its normal dimension once the neck portion is placed into the opening. The ridge, however, permits removal of the head shaped member from the body when pulled with enough force.

The inner diameter of the neck portion is preferably dimensioned to frictionally engage the shank so that it can maintain the cap in its place relative to the handle.

The toy tool according to the present invention has a separate utility other than as a tool. Specifically, with the cap in its place relative to the handle, the human-like figure can be used as a part of a construction kit. In particular, in a toy construction kit, either just the cap or the entire human-like configured tool can be placed as a driver of a car, a pilot of a plane or an engineer of a train, etc. More particularly, the foot 38 or the recess 28 of the cap can be used to stably interfit or connect with a complementary fittings on the construction kit.

The entire hand tool can be made of any suitable plastic, wood or metal. However, it is preferable to from the hand tool from plastic materials such as ABS, nylon, etc.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be limited to as set forth in the appended claims.

What is claimed is:

1. A human-like configured hand tool comprising:

a handle having an upper end and a lower end;

a shank extending from said handle upper end and affixed thereto so that there is no relative rotation between said handle and shank;

a driver member formed on a free end of said shank for applying torque to a coupling device; and a cap having a chamber dimensioned to permit insertion of said shank, and an engaging portion for frictionally engaging at least a portion of said shank, said cap having a length to permit a complete insertion of said shank thereinto and contact said handle, wherein said handle is shaped as a lower half of a human-like figure and said cap is shaped as an upper half of a human-like figure, said cap and said handle together completing a human-like figure when said cap is placed over said shank.

2. A human-like configured hand tool according to claim 1, wherein said upper and lower ends of said handle are substantially flat, said flat lower end permitting said hand tool to stand upright.

3. A human-like configured hand tool according to claim 2, wherein said cap comprises an upper end and a lower end, said lower end being substantially flat and engages said flat upper end of said handle when said cap is fully placed over said shank.

4. A human-like configured hand tool according to claim 3, wherein said cap includes a head shaped member rotatably connected to said upper end thereof.

5. A human-like configured hand tool according to claim 4, further comprising an alignment projection extending from one of said substantially flat upper end of said handle and said flat lower end of said cap, and a complementary hole formed on the other of said substantially flat upper end of said handle and said flat lower end of said cap, wherein said projection permits a proper alignment of said cap with said handle to form a human-like configuration.

6. A human-like configured hand tool according to claim 4, wherein said head shaped member includes a neck portion dimensioned to engage said at least a portion of said shank to frictionally hold said cap in place relative to said handle.

7. A human-like configured hand tool according to claim 6, further comprising a collar formed at said flat upper end of said handle and concentric with said shank, and a complementary recess formed at said flat lower end of said cap.

8. A human-like configured hand tool according to claim 7, further comprising an alignment projection extending from one of said substantially flat upper end of said handle and said flat lower end of said cap, and a complementary hole formed on the other of said substantially flat upper end of said handle and said flat lower end of said cap, wherein said projection permits a proper alignment of said cap with said handle to form a human-like configuration, said projection further preventing said cap from rotating relative to said handle.

9. A human-like configured hand tool according to claim 7, wherein said driver member is integrally formed with said shank and has a triangular cross-section for imparting rotational force to a fastener having a complementary triangular recess.

10. A human-like configured hand tool according to claim 9, in combination with an extension driver member having a driver member formed at one end and a complementary triangular recess at the opposite end for engaging said triangular driver member of said shank.

11. A human-like configured hand tool according to claim 10, wherein said driver member of said extension also has a triangular cross-section.

12. A human-like configured hand tool according to claim 1, in combination with an extension having a driver member formed at one end and a recess at the other end complementary to said driver member of said shank.

13. A human-like configured hand tool according to claim 12, wherein said driver member of said extension has a triangular cross-section.

14. A human-like configured hand tool according to claim 1, further comprising means for aligning said cap and said handle to form the human-like configuration.

15. A human-like configured hand tool comprising:

a handle having an upper end and a lower end;

a shank extending from said upper end;

a driver member formed on a free end of said shank; and a cap having a chamber dimensioned to permit insertion of said shank, and an engaging portion for frictionally engaging at least a portion of said shank, said cap having a length to permit a complete insertion of said shank thereinto and contact said handle, wherein said handle is shaped as a lower half of a human-like figure and said cap is shaped as an upper half of a human-like figure, said cap and said handle together completing a human-like figure when said cap is placed over said shank, and wherein said cap comprises a head shaped member that includes a neck portion dimensioned to engage said at least a portion of said shank to frictionally hold said cap in place relative to said handle.

* * * * *